US008938377B1

(12) United States Patent
Kopasakis

(10) Patent No.: US 8,938,377 B1
(45) Date of Patent: Jan. 20, 2015

(54) ATMOSPHERIC TURBULENCE MODELING FOR AEROSPACE VEHICLES: FRACTIONAL ORDER FIT

(75) Inventor: George Kopasakis, Westlake, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 385 days.

(21) Appl. No.: 13/474,948

(22) Filed: May 18, 2012

Related U.S. Application Data

(60) Provisional application No. 61/488,388, filed on May 20, 2011.

(51) Int. Cl.
*G06G 7/48* (2006.01)

(52) U.S. Cl.
USPC ..... 703/6

(58) Field of Classification Search
CPC ..... G01C 21/00; G01N 21/01; G02B 27/58; G02B 23/12; G02F 1/00; G06F 17/10; G06G 7/48; G06K 9/40; G06K 9/00; G08B 21/18; H04B 10/00; H04N 5/228; H04R 1/20
USPC ..... 703/6, 9; 398/129; 73/865.6; 382/107; 359/399, 429
See application file for complete search history.

(56) References Cited

U.S. PATENT DOCUMENTS

| | | | | |
|---|---|---|---|---|
| 2006/0024061 | A1 * | 2/2006 | Wirth et al. | 398/129 |
| 2006/0177102 | A1 * | 8/2006 | McGraw et al. | 382/107 |
| 2008/0259447 | A1 * | 10/2008 | Oppenheimer | 359/399 |
| 2010/0192709 | A1 * | 8/2010 | Wilcox et al. | 73/865.6 |

OTHER PUBLICATIONS

Nurdin et al., "Rational approximation of the power spectral density of atmospheric turbulence arising in adaptive optics", University of Twente, Sep. 2003.*
de Man et al., "First results with an adaptive optics test bench", Adaptive optical system technologies, SPIE, 2003.*
Kopasakis, George; "Atmospheric Turbulence Modeling for Aero Vehicles: Fractional Order Fits"; NASA/TM-2010-216961.

* cited by examiner

*Primary Examiner* — Kandasamy Thangavelu
(74) *Attorney, Agent, or Firm* — Robert H. Earp, III

(57) ABSTRACT

An improved model for simulating atmospheric disturbances is disclosed. A scale Kolmogorov spectral may be scaled to convert the Kolmogorov spectral into a finite energy von Karman spectral and a fractional order pole-zero transfer function (TF) may be derived from the von Karman spectral. Fractional order atmospheric turbulence may be approximated with an integer order pole-zero TF fit, and the approximation may be stored in memory.

20 Claims, 12 Drawing Sheets

ATMOSPHERIC TURBULENCE MODELING FOR AEROSPACE VEHICLES: FRACTIONAL ORDER FIT

CROSS REFERENCE TO RELATED APPLICATIONS

This application is a non-provisional of, and claims priority to, U.S. Provisional Patent Application Ser. No. 61/488,388, filed May 20, 2011, the Subject matter of which is hereby incorporated by reference in its entirety.

ORIGIN OF THE INVENTION

The invention described herein was made by an employee of the United States Government and may be manufactured and used by or for the Government for Government purposes without the payment of any royalties thereon or therefore.

FIELD

The present invention generally pertains to modeling, and more specifically, to modeling atmospheric turbulence for the design and safety compliance of aerospace vehicles using a fractional order fit.

BACKGROUND

Atmospheric turbulence models are often beneficial for the design and safety compliance of aerospace vehicles. For instance, such models are often used for the design of inlet/engine and flight controls, as well as for studying coupling between the propulsion and the vehicle structural dynamics for supersonic vehicles. Models based primarily on the Kolmogorov spectrum have been previously utilized to model atmospheric turbulence. The Kolmogorov spectrum has an energy level that approaches infinity as frequency approaches zero. This characteristic makes it difficult to implement conventional models in the time domain. The Kolmogorov model has also been extended in the Tank model to develop a baseline of atmospheric turbulence for the High Speed Civil Transport (HSCT). The Tank model also covers atmospheric acoustic wave disturbance modeling utilizing the von Karman spectral.

An approximation of the Kolmogorov model that is commonly used with a finite energy spectrum is the von Karman type model. However, simulating the von Karman type models in the time domain may be difficult due to the fractional order of von Karman type models.

Some have used Dryden model approximation to the fractional order von Karman atmospheric model. However, the Dryden model is second order compared to the 5/3 fractional order of the acoustic velocity atmospheric turbulence spectral. Thus, the Dryden model underestimates the atmospheric disturbance, and does so increasingly with higher frequency. As such, the faster an aerospace vehicle travels, the more the Dryden model will underestimate the atmospheric disturbance. Accordingly, a more accurate model for simulating atmospheric disturbances may be beneficial.

SUMMARY

Certain embodiments of the present invention may be implemented and provide solutions to the problems and needs in the art that have not yet been fully solved by conventional atmospheric modeling approaches. For example, certain embodiments of the present invention utilize a fractional order fit to create accurate models of atmospheric turbulence. This modeling methodology may be implemented in software, hardware, or a combination of the two.

In one embodiment of the present invention, a computer program embodied on a computer-readable storage medium is configured to cause a processor to scale a Kolmogorov spectral to convert the Kolmogorov spectral into a finite energy von Karman spectral and derive a fractional order pole-zero transfer function (TF) from the von Karman spectral. The computer program is also configured to cause the processor to approximate fractional order atmospheric turbulence with an integer order pole-zero TF fit and store the approximation in memory.

In another embodiment of the present invention, a computer-implemented method includes simulating, by a processor, atmospheric disturbances in both a time and frequency domain using an integer order pole-zero TF fit of a fractional order TF. The computer-implemented method also includes displaying, on a display device, a graphical representation of the integer order pole-zero TF fit.

In yet another embodiment of the present invention, an apparatus includes physical memory including computer program instructions and a processor configured to execute the computer program instructions. The processor is configured to determine simulated atmospheric disturbances using an integer order pole-zero TF fit of a fractional order TF, and store the integer order pole-zero TF fit in the memory.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Embodiments of the present invention simulate atmospheric disturbances in both the time and frequency domain using integer order TF fits of fractional order TFs. More specifically, such embodiments approximate fractional order atmospheric turbulence with integer order pole-zero transfer function fits for more accurate frequency and time domain simulations. von Karman type model forms of the Kolmogorov spectral are constructed for the acoustic velocity gusts disturbances for both longitudinal and transverse disturbances, and separately for ambient temperature and temperature generated wind gusts, as well as pressure disturbances and density, if desirable.

Figure 11:
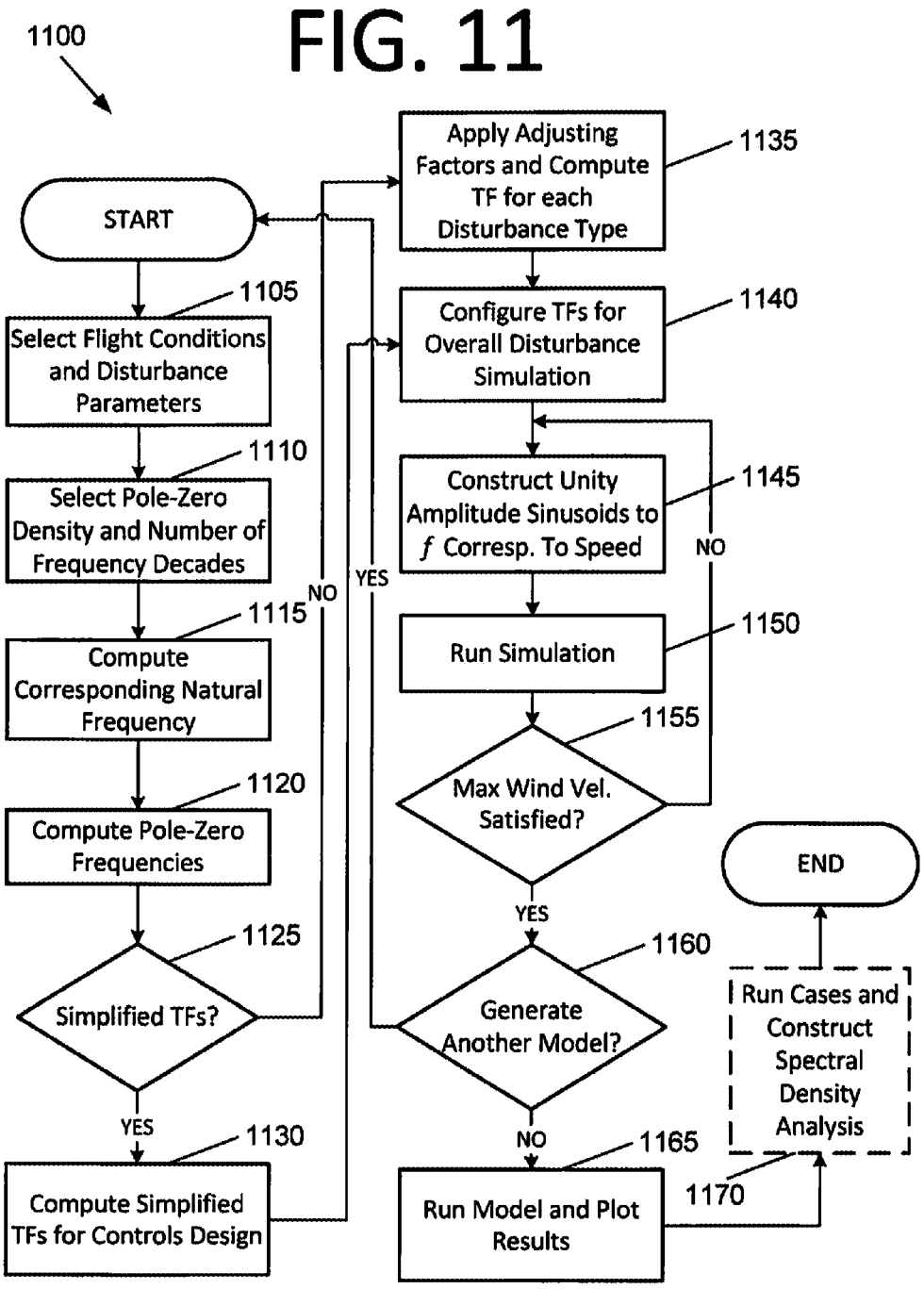
FIG. 11 is a flowchart illustrating a method of approximating fractional order atmospheric turbulence with integer order pole-zero transfer function fits, according to an embodiment of the present invention.

In some embodiments, a computer program that performs the modeling may run on an ordinary simulation development platform or any suitable compiler on a conventional computer. The simulation program may be configured to compute fractional order von Karman type TF approximations of the Kolmogorov spectra and compute the transfer function parameters associated with the atmospheric disturbance parameters, which may depend on the flight condition, vehicle speed, and selected atmospheric disturbance parameters (e.g., worst case conditions). The simulation program may approximate the fractional order atmospheric turbulence with integer order pole-zero TFs, with the results displayed in the simulation environment in terms of the parameters of the various TFs and by plotting selected disturbances in the frequency domain. Also, the TFs may be simulated in the particular simulation environment and appropriate time domain simulations may be developed, selected analyses may be conducted, and the results may be plotted. The flow logic of the computation process of the algorithm in such embodiments is shown in FIG. 11, which is discussed in more detail below. While different embodiments of the present invention can exist, with variations in the types of analyses and the results displayed, a feature of many embodiments is the methodology of scaling atmospheric disturbances into von Karman type forms and approximating their fractional order nature by computing products of integer order TFs to fit the fractional order.

Because of the fractional order of these models, a circuit equivalent of atmospheric disturbances with associated capacitance and resistances, computed as a function of atmospheric disturbance parameters, is developed and used as the basis to derive the integer order pole-zero approximations. Utilizing such formulations, the transfer function poles and zeros of these approximations to the atmospheric disturbances can be directly computed for different parameters describing atmospheric turbulence. The model is derived to duplicate the fractional order form of real atmospheric turbulence and is more accurate than conventional models.

The models may be computed and simulations may be performed over a wide range of altitudes and a wide degree of variations in atmospheric turbulence conditions. Some embodiments may be relatively easy to implement and may be highly representative of the actual fractional order nature of atmospheric turbulence. Embodiments may be applicable to propulsion system flow field type disturbances and vehicle gust loads. These new models could be used to design controls for aerospace vehicle propulsion or flight control systems.

Fractional Order Fit of Atmospheric Turbulence Model

Atmospheric disturbance has a fractional order in nature, meaning that rather than a whole number, the order is a fraction such as 5/3. Fractional order differential equations are difficult to explicitly or numerically solve. This is because fractional order derivatives, unlike integer order derivatives, do not obey the locality law (i.e., the limit theorem). Rather, fractional order derivatives obey the law of non-locality. This property makes the state transition matrix a convolution integral, with each integration step necessitating the computation of the convolution of the state all the way back to time zero where the state had an initial value of zero.

Accordingly, embodiments of the present invention derive integer order pole-zero product TF approximations to simulate fractional order atmospheric disturbances. The methodology of embodiments of the present invention is derived such that integer order TF approximations of atmospheric disturbance are symmetrically centered about the fractional order TF by interleaving integer order poles and zeros. Correction factors to the transfer function parameters have been developed for the different type of disturbances so that a good fit is achieved for a density of one pole-zero pair per frequency decade. If for some reason a higher accuracy is desired, which is likely unnecessary for many implementations, the same process can be followed for increased pole-zero densities. In an embodiment (as shown in the figures), plots of the von Karman spectra and the respective TF approximations are directly generated to compare these accuracies.

The idea behind the staircase (pole-zero) approximation of the fractional order is to increase the accuracy of the staircase approximation by increasing the density of pole-zero pairs per frequency decade so that with increased pole-zero density, the steps become shorter, eventually collapsing to the straight line of the fractional order TF as the number of poles and zeros of the approximation increase to infinity. For such an approach to work, the frequency of the poles and zeros need to be related to the atmospheric disturbance parameters and also be derived in a way such that the staircase TF approximation is symmetrically centered about the fractional order TF.

The Kolmogorov spectral represents the spectral density of a structured random field of atmospheric turbulence as $$S_t(k)=\alpha_t\epsilon^{2/3}k^{-5/3} \tag{1}$$

where $S_t(k)$ signifies the type of disturbance, $\alpha_t$ is a constant for each type of disturbance, $\epsilon$ represents the eddy dissipation rate ($m^2/sec^3$), and k represents the wave number (cycles/m). More specifically, $\alpha_l=0.15$ for the longitudinal wind velocity gust in the direction of flight (dimensionless), $\alpha_v=0.2$ for the vertical or horizontal wind velocity gust (dimensionless), $\alpha_T=0.39$ for temperature disturbance ($°K^2s^2m^{-2}$), and $\alpha_t=5\times10^{-4}(P/T)^2$ for pressure disturbance ($Pa^2s^2\,m^{-2}$), where P and T are in total atmospheric quantities.

For an in-flight vehicle encountering atmospheric turbulence with a wavenumber k (in cycles/m), the disturbance frequency (up to) experienced by the vehicle may be determined by $$f = \frac{Ma}{\lambda} = kMa \tag{2}$$

where M is the vehicle Mach number, $\alpha$ is the local speed of sound (m/sec), which is altitude-dependent, and $\lambda$ ($k=1/\lambda$) is the wavelength of the atmospheric turbulence (m/cycle). Later, Tank scaled the von Karman spectrum to fit the Kolmogorov model approaching the limit (i.e., for large values of k), which compares well with other data. For longitudinal distance, this spectrum is $$S_{t,VK}(k) = 2.7\varepsilon^{2/3}L^{5/3}\frac{2}{[1+(1.339(2\pi)Lk)^2]^{5/6}} \tag{3}$$

For transverse disturbances, this spectrum is $$S_{v,VK}(k) = 2.7\varepsilon^{2/3}L^{5/3}\frac{1+\frac{8}{3}(1.339(2\pi)Lk)^2}{[1+(1.339(2\pi)Lk)^2]^{11/6}} \tag{4}$$

In a nutshell, embodiments of the present invention were developed to fit the fractional order equations (3) and (4) with a product of first order poles and zeros symmetrically located on top of the fractional order for the acoustic waves. For temperature and pressure, equation (3) for the acoustic wave is scaled by the differences in magnitude between the Kolmogorov acoustic wave and the Kolmogorov temperature and pressure, respectively (see equation (1)). Then, the same approach is followed to fit the temperature and pressure spectral with products of first orders TFs. Finally, the fit TFs are adjusted with proportionality factors to improve the fit for the final TFs. Equation (2) is utilized to calculate the frequency based on the speed of the vehicle and size of the atmospheric turbulence, up to which unit amplitude sinusoids are constructed as inputs to the TFs to provide for time domain simulations.

The following description pertains to algorithms developed with respect to embodiments of the present invention. The values of the equivalent capacitance and resistance of atmospheric turbulences may be determined by $$C_t = \frac{1}{(a_t\varepsilon^{2/3})^{1/x}(2\pi Ma)} \tag{5}$$

$$R_t = 1.3390(2\pi)(a_t\epsilon^{2/3})^{1/x}L \tag{6}$$

where $C_t$ is the equivalent electric circuit capacitance (farads) for t-type disturbance, $R_t$ is the equivalent electric circuit resistance (ohms) for t-type disturbance, $a_t$ is a constant for t-type disturbance, a is the speed of sound, $\epsilon$ is the eddy dissipation rate ($m^2/sec^3$), x is the fractional order of the atmospheric disturbance spectral, M is the Mach number, and L is the integral length scale (m). The corresponding natural frequency $\omega_n$ may be computed as $$\omega_n = \frac{K_{\omega n}}{R_t C_t} \tag{7}$$

where $k_{\omega n}$ is the adjustment factor, which equals 1, but is represented in this form in case any adjustments need to be made to the atmospheric disturbance natural frequency.

Utilizing these circuit analog parameters, a time domain disturbance can be derived based on an integer order TF approximation for atmospheric turbulence given the atmospheric disturbance parameters $\epsilon$, L, q, t, and r for the units conversion factor (with q=xr; x=5/3 and r=⅓ for acoustic disturbances and ½ for temperature and pressure) as $$W_{t,o} \cong K_{t,fit}\frac{\prod_{1}^{m_z}(s/\omega_{zi}+1)}{\prod_{1}^{m_p}(s/\omega_{pi}+1)}W_t \tag{8}$$

where $W_t$ is a series of sinusoids with unit amplitude frequency components distributed over the frequency range of interest, $m_z$ is the number of zeros in the TF approximation, $m_p$ is the number of poles in the TF approximation, s is the Laplace operator, $\omega_{zi}$ is the frequency of TF zero i of the integer order approximation (rad/sec), and $\omega_{pi}$ is the frequency of TF pole of integer order approximation (rad/sec).

The frequencies of the poles can be computed as $$\omega_{pi} = \frac{K_{\omega pi}\omega_{Hpi}\prod_{j=1}^{i-1}(\omega_{Hpi}/\omega_{pi-j}+1)}{10^{\eta(2t-1)*q}\prod_{j=1}^{i-1}(\omega_{Hpi}/\omega_{zi-j}+1)-1} \tag{9}$$

$$i = 2, 3 \ldots, m_p$$

where $\eta$ is the ratio of each decade interval where a pole or a zero will be used to estimate the fractional order TF and q is the fractional order of the equivalent electrical circuit, and where the first pole is computed as follows:

$$\omega_{p1} = \omega_n(10^{\eta q}-1)\frac{1-q}{q} \tag{10}$$

and the frequencies of the zeros can be computed as $$w_{zi} = \frac{K_{\omega zi}\omega_{Hzi}\prod_{j=1}^{i-1}(\omega_{Hzi}/\omega_{zi-j}+1)}{10^{-2\eta i*q}\prod_{j=1}^{i}(\omega_{Hzi}/\omega_{pi}+1)-1} \tag{11}$$

$$i-1, 2 \ldots m_z$$

For a number n of frequency decades to be estimated, the number of poles and zeros in the TF approximation can be determined by $$m_p = (n-1)/\eta \tag{12}$$

$$m_z = m_p - 1 \tag{13}$$

For a desirable zero-pole density pair $\rho_{pz}$ per decade to be used to approximate the fractional order disturbance $$\eta = \frac{1}{2\rho_{pz}} \tag{14}$$

and the terms $\omega_{Hpi}$ and $\omega_{Hzi}$ in equations (9) and (11) can be computed as $$\omega_{Hpi}=\omega_n(10^{\eta q(2i-1)}-1)^{1/q} i=2,3,\ldots,m_p \tag{15}$$

$$\omega_{Hzi}=\omega_n(10^{2\eta qi}-1)^{1/q} i=2,3,\ldots,m_z \tag{16}$$

The utility of $\omega_{Hpi}$ and $\omega_{Hzi}$ is to maintain symmetry so that the staircase pole-zero approximation is symmetrically located on top of the fractional order TF asymptote. The proportional gains $K_{\omega pi}$ and $K_{\omega zi}$ in equations (9) and (11) are reserved for final adjustments that may be needed to these frequencies for more closely approximating the fractional order TFs representing atmospheric disturbance.

Longitudinal and Transverse Acoustic Wave Turbulence

Figure 1:
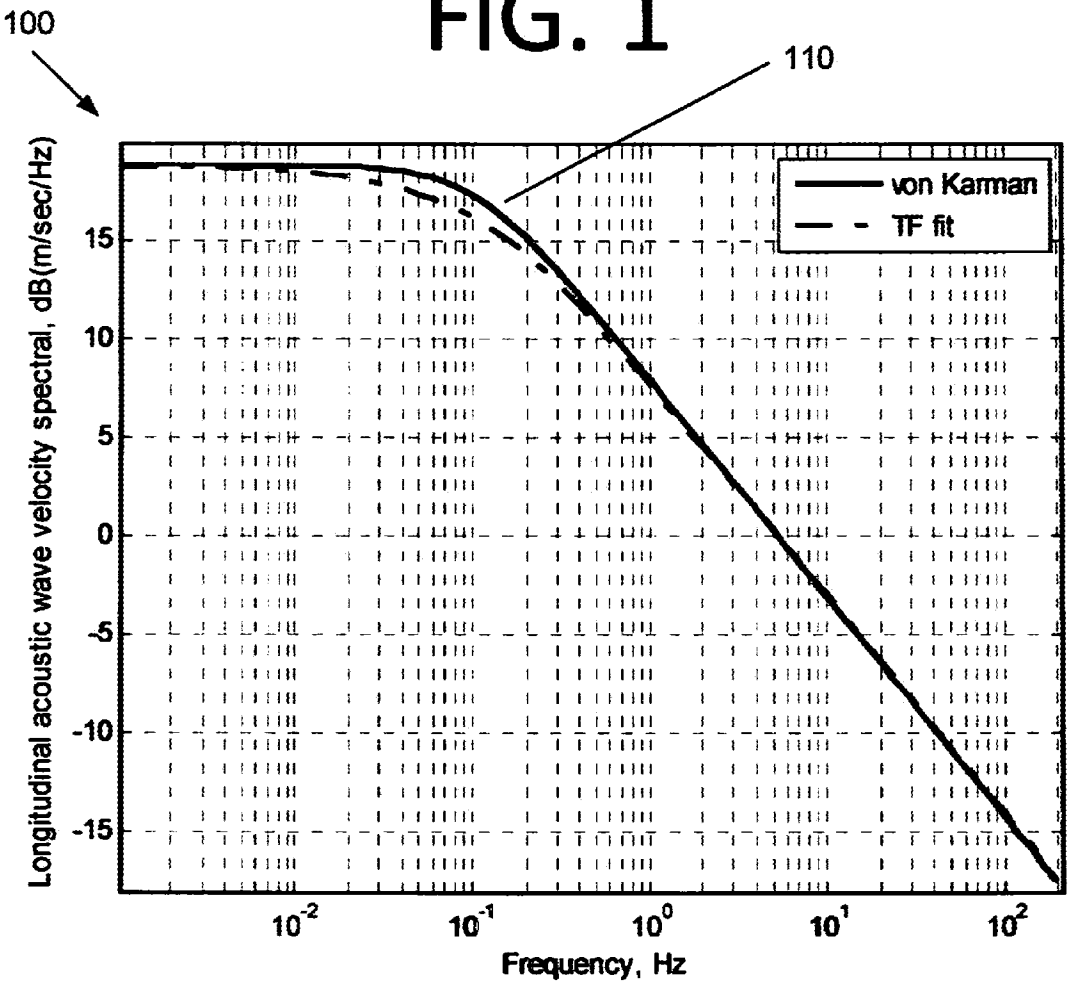
FIG. 1 illustrates a graph of a longitudinal von Karman spectral and a final adjusted TF fit, according to an embodiment of the present invention.
Figure 2:
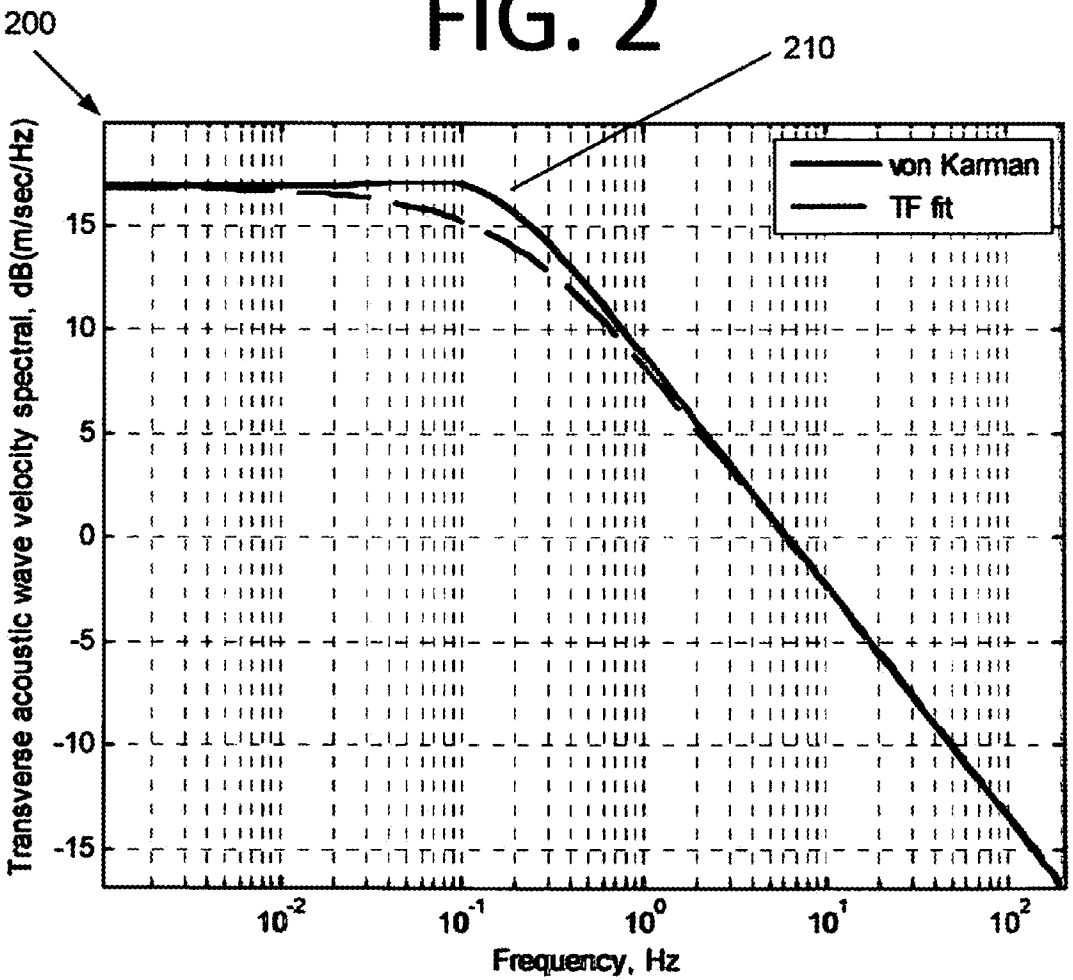
FIG. 2 illustrates a graph of a transverse von Karman spectral and a final adjusted TF fit, according to an embodiment of the present invention.

The longitudinal and transverse acoustic wave atmospheric disturbances are in the form of pure wind gusts in the axial direction of vehicle motion and in the vertical direction of motion, respectively. Utilizing equations (5) through (16) with q=xr=⅚ (r=⅓), then $K_{t,fit}$ in equation (8), based on inspection of the Tank model from equations (3) and (4), is $$K_{l,fit}=(5.4\epsilon^{2/3}L^{5/3})^{1/3} \tag{17}$$

for the longitudinal disturbance, and $$K_{v,fit}=(2.7\epsilon^{2/3}L^{5/3})^{1/3} \tag{18}$$

for the transverse disturbance. For n=3 (i.e., the TF fit over the span of 3 decades in frequency), the proportionality factor adjustments to improve these fits have been found to be $$K_{l,\omega}=[K_{\omega n};K_{\omega pi};K_{\omega zi}]=[2.4;1\ 1\ 1/2.4\ 1/1.5;1\ 1\ 1] \tag{19}$$

for the longitudinal acoustic wave, and $$K_{v,\omega}=[K_{\omega n};K_{\omega pi};K_{\omega zi}]=[4.27;1\ 1\ 1/2.4\ 1/1.5;1\ 1\ 1] \tag{20}$$

for the transverse. These TF fits may be compared against the Tank von Karman spectral equations (3) and (4) with units conversion exponent r, shown in graphs 100 and 200 of FIGS. 1 and 2 for $\epsilon$=8.6e-5 ($m^2/sec^3$) and L=762 m. As shown in these figures, the fits provide a good approximation of these disturbances. More accuracy can be achieved around knees 110 and 210 of these spectrals by increasing the density of pole-zero pairs per frequency decade in this region. While there may be a certain level of inaccuracy at lower frequencies, this is acceptable since typical control system designs have no problem attenuating disturbances at low frequency ranges (i.e., for the frequencies shown in the figures around the knees and below).

Temperature Turbulence

Atmospheric temperature turbulence causes both temperature and acoustic velocity disturbances due to changes in the speed of sound. For the most part, temperature disturbances result in vertical displacement of air parcels (i.e., "gravity waves"). Thus, acoustic velocity disturbances caused by temperature will generate vertical wind gusts that add with any transverse acoustic velocity gusts. For a propulsion system, the wing forebody will turn a vertical gust into a longitudinal gust by multiplying the vertical gust by the conversion factor $$(M_\infty - 1)\Big/\sqrt{M_\infty^2 - 1}\,.$$

This factor amounts to 0.63 for $M_\infty$=2.35, and can be ignored for worst-case purposes.

Temperature turbulence spectral density also follows the 5/3 law, but its units are in terms of Kelvin squared. Thus, in order to convert the units to Kelvin, the exponent r becomes ½, which makes the fractional order q=⅚. Based on this, the TF fit performed for temperature is done in a similar fashion as with the acoustic waves discussed in the previous section (i.e., utilizing equations (5) through (16)), with additional relations.

$$K_{T,fit(temp)}=\sqrt{14.0\epsilon^{2/3}L^{5/3}} \tag{21}$$

$$K_{T,\omega}=[K_{\omega n};K_{\omega pi};K_{\omega zi}]=[1.5;1\ 1\ 1/1.1\ 1/1.2;1\ 1\ 1] \tag{22}$$

These relations have been derived by utilizing the Kolmogorov spectral of equation (1) to compute the difference in magnitude between the Kolmogorov acoustic wave and that of the temperature, then scaling the von Karman type tank model of equation (3) by this difference in magnitude in order to generate the von Karman type model for temperature.

Figure 3:
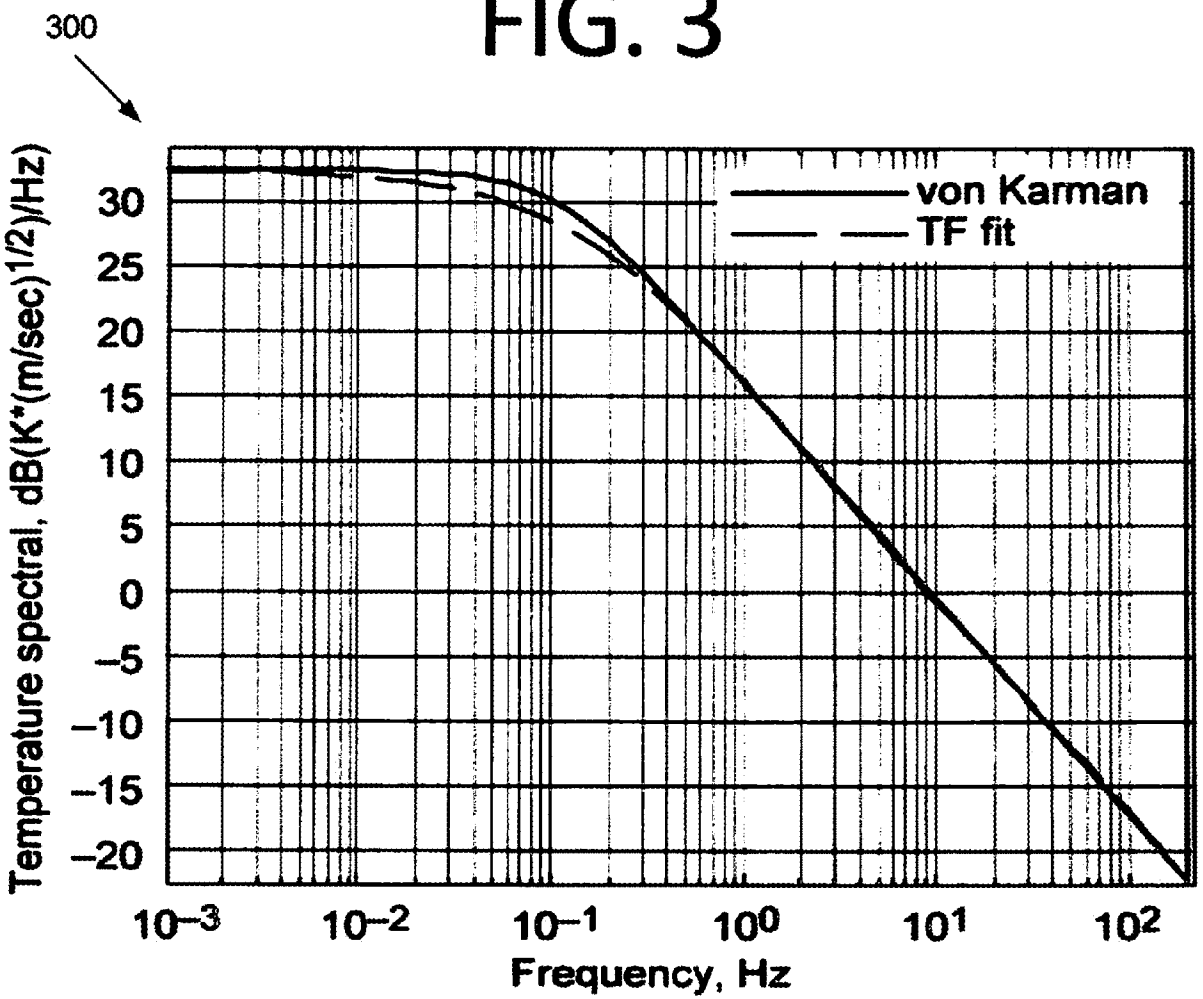
FIG. 3 illustrates a graph of a temperature von Karman spectral and its TF fit, according to an embodiment of the present invention.

Graph 300 of FIG. 3 shows this TF fit with the Tank spectral of equation (3) (i.e., equation (3) substituting the scaled equation (21) for the numerator and by also applying the units conversion factor in the denominator for $\epsilon$=8.6e-5 ($m^2/sec^3$) and L=762 m). The proportionality factors $K_t$ for all of the fits can also be considered part of the formulations. Their accuracy at higher frequencies starts deviating somewhat with higher values of L (integral length scales of a few thousand meters and above), values that are considered to be outside of the typical range. L=762 m is considered to be standard in the aerospace industry.

Temperature turbulence also causes acoustic wave gusts due to change of the local speed of sound. The speed of sound is related with temperature as $$a=\sqrt{\gamma R T_s} \tag{23}$$

where $T_s$ is the static temperature in degrees Kelvin and $\gamma$ is the ratio of specific heats (−1.41). By perturbing the relation of the speed of sound and temperature in equation (23) and substituting the resulting expression for $\Delta a$ into the Mach number equation of M=v/a, the relation between the change in temperature and acoustic velocity can be obtained as $$\Delta v = \frac{MyR}{2a_o}\Delta T \tag{24}$$

This relation can be applied to equation (21) to compute $K_{T,fit(acoustic)}$ for the acoustic wave velocity disturbance due to an atmospheric temperature fluctuation as $$K_{T,fit(acoustic)} = \frac{MyR}{2a_o}\sqrt{14.0\varepsilon^{2/3}L^{5/3}} \tag{25}$$

Equation (25) is applicable to transverse or vertical wind gust disturbances generated by temperature turbulence, and accurate in the worst case sense for longitudinal wind gusts, especially at higher supersonic Mach numbers (i.e., for Mach numbers higher than 2.35, the wing forebody in a propulsion system, mentioned earlier as the conversion factor, turns a transverse to a longitudinal disturbance using a factor calculated to be 0.63 at Mach 2.35). Generally, longitudinal wind gusts due to temperature variations can be expressed as follows by using this conversion factor $$(M_\infty - 1)\Big/\sqrt{M_\infty^2 - 1}$$

$$K_{T,fit(longitudinal)} = \frac{M_\infty(M_\infty - 1)\gamma R}{2a_o\sqrt{M_\infty^2 - 1}}\sqrt{14.0\varepsilon^{2/3}L^{5/3}} \tag{26}$$

Figure 4:
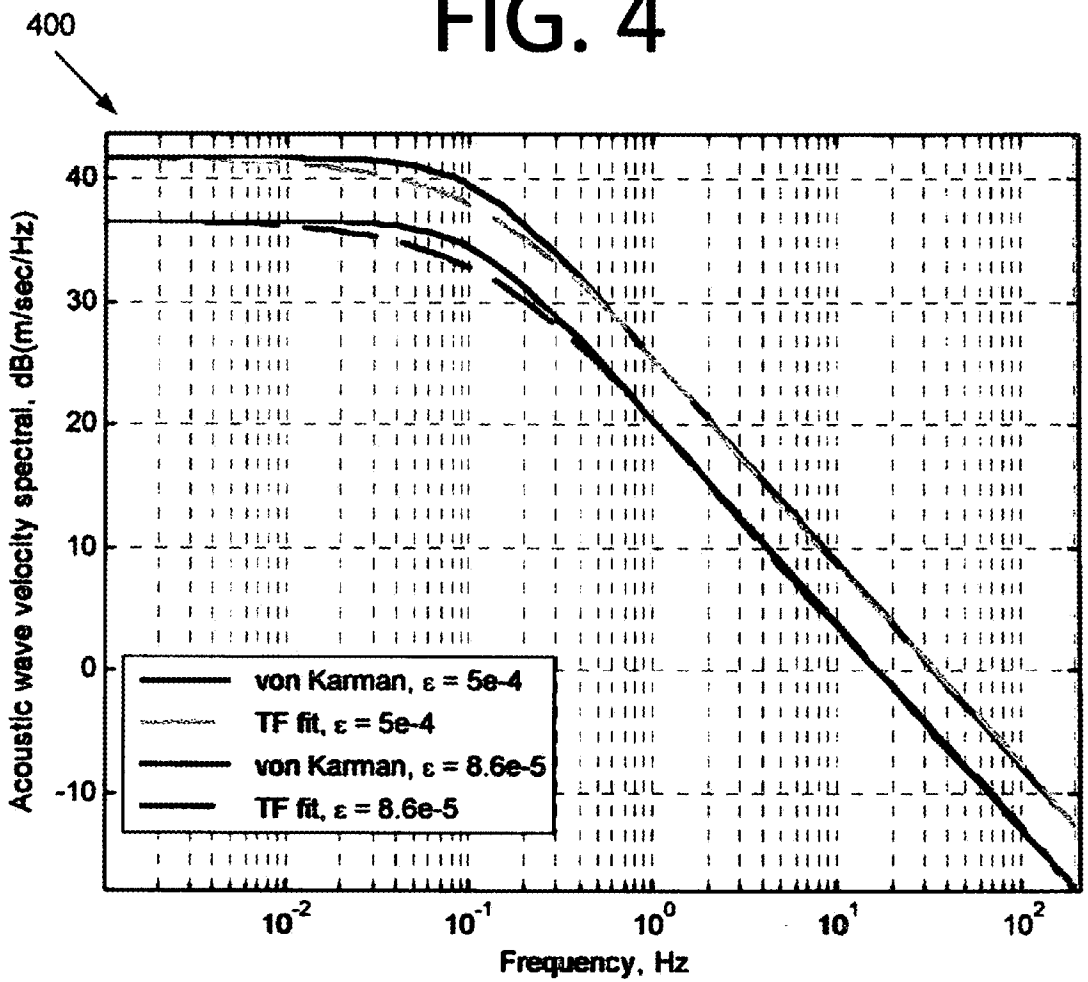
FIG. 4 illustrates a graph of a von Karman acoustic wave velocity spectral due to temperature gust and its TF fits for different eddy dissipation rates (L=762 m), according to an embodiment of the present invention.
Figure 5:
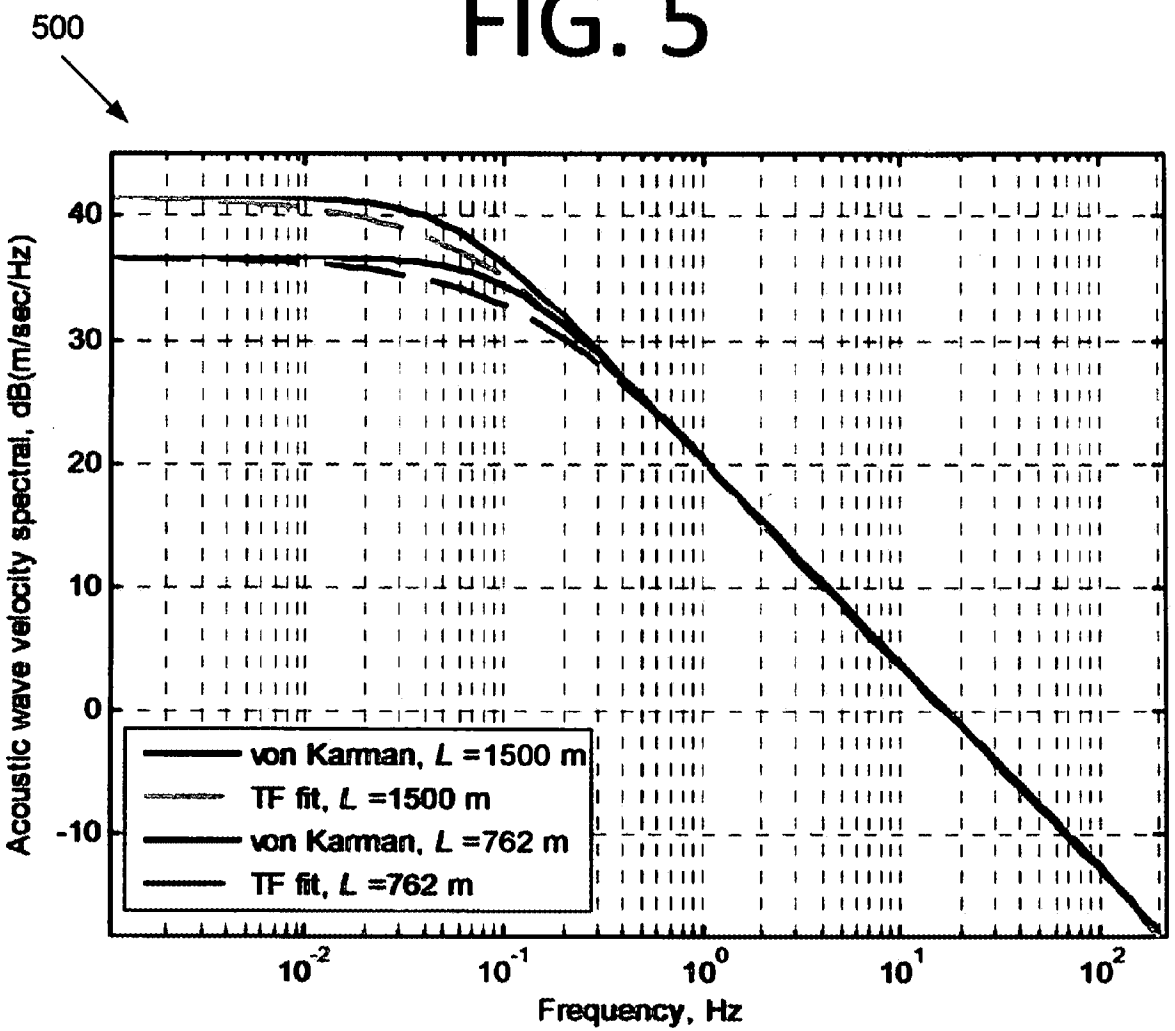
FIG. 5 illustrates a graph of a von Karman acoustic wave velocity spectral due to temperature gust and its TF fits for different integral scale lengths ($\epsilon$=8.6e-5 $m^2/sec^3$), according to an embodiment of the present invention.

This TF fit for the acoustic velocity disturbance at supersonic cruise altitude, at Mach 2.35, for L=762 m and two different values of $\epsilon$ (5e-4 and 8.6e-5) is shown in graph 400 of FIG. 4. The TF fit for $\epsilon$=8.6e-5 and for two different values of integral scale lengths is shown in graph 500 of FIG. 5. As can be seen from FIGS. 4 and 5 compared to FIG. 1, the acoustic velocity gusts produced by fluctuations in temperature are much higher in amplitude than those produced by pure acoustic velocity gusts.

For the combined acoustic wave, the acoustic wave velocity due to temperature gust dominates in the low frequency range and at higher frequencies both acoustic waves affect the total. In the worst case, it can be assumed that both effects of the acoustic wave velocity can combine. It is also assumed that both the longitudinal and transverse acoustic wave velocities will not combine to produce worst case affects. For engines under the wing, the transverse wave can be assumed to be converted to a longitudinal wave via the wing forebody.

Pressure Turbulence

To develop the von Karman type model for pressure, the same scaling process as described in the temperature section may be followed for pressure. The units conversion exponent for pressure is the same as that for temperature (i.e., r=½), which makes the fractional order the same (i.e., q=⅚). As such, $K_{P,fit}$ and $K_{P,\omega}$ may be computed as follows $$K_{P,fit}=\sqrt{11.6\epsilon^{2/3}L^{5/3}} \tag{27}$$

$$K_{P,\omega}=[K_{\omega n};K_{\omega pi};K_{\omega zi}]=[1.5;1\ 1\ 1/1.1\ 1/1.2;1\ 1\ 1] \tag{28}$$

Figure 6:
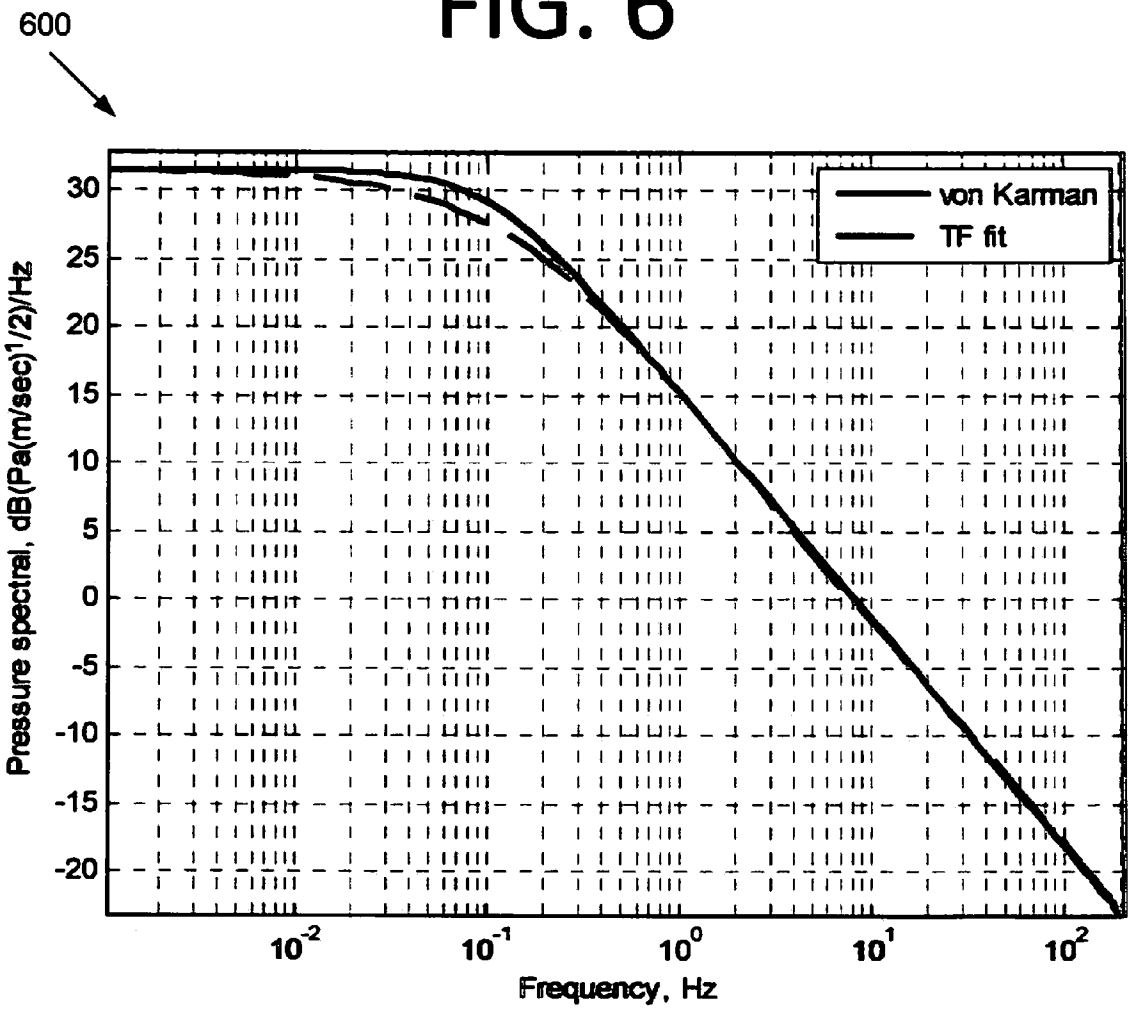
FIG. 6 illustrates a graph of a pressure von Karman spectral and its TF fit ($\epsilon$=8.6e-5 $m^2/sec^3$, L=762 m), according to an embodiment of the present invention.

Graph 600 of FIG. 6 shows this TF fit for $\epsilon$=8.6e-5 $m^2/sec^3$ and L=762 m compared to the scaled von Karman type spectral (i.e., equation (27) substituted for the numerator and proportional factor of equation (3) and the denominator of equation (3), raised to the power r).

Density Turbulence

Density disturbances are contained within temperature and pressure fluctuations. As such, its inclusion in a simulation, along with pressure and temperature, will produce unnecessary additional disturbances. However, if need be, the relation of density disturbance with temperature and pressure can be derived by perturbing the state equation as $$\Delta\rho = \frac{P_O\Delta P}{R(T_O + \Delta T)} - \frac{P_O}{RT_O} \tag{29}$$

Figure 7:
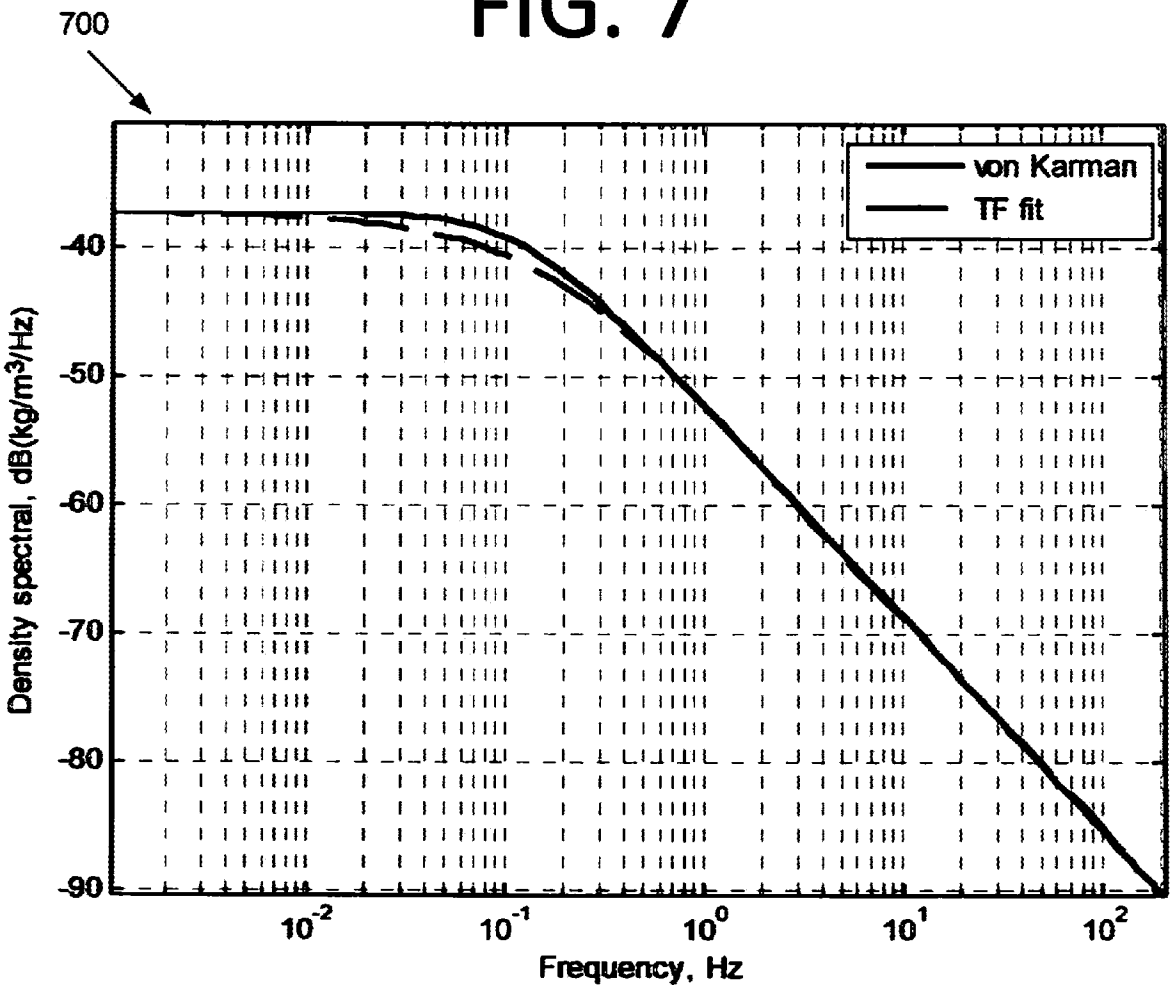
FIG. 7 illustrates a graph of a density von Karman spectral and its TF fit ($\epsilon$=8.6e-5 $m^2/sec^3$, L=762 m), according to an embodiment of the present invention.

A plot of density disturbance utilizing equation (29) is shown in graph 700 of FIG. 7.

Simplified Atmospheric Turbulence Model for Controls Design

The fractional order TF fit may be further simplified by identifying certain characteristics of this model that are important for controls design in order to handle atmospheric turbulence. Based on observations utilizing FIG. 4, differences in eddy dissipation rates $\epsilon$ produce spectral densities with the same frequencies, offset by a fixed magnitude. This offset is accounted by differences in TF gain.

Calculating these frequencies using the formulations developed so far also supports this observation. Differences in the fractional order of the disturbances, such as longitudinal acoustic wave velocity versus temperature will produce different spectral frequencies. Unlike differences in eddy dissipation rates that produce the same frequencies with different TF magnitudes, inspection of FIG. 5 shows that spectral with different integral length scales L may be represented by different frequencies. However, different integral length scales may only affect the low frequency spectral, where a typical feedback controls design should have no difficulty attenuating disturbances at such a low frequency range.

Figure 8:
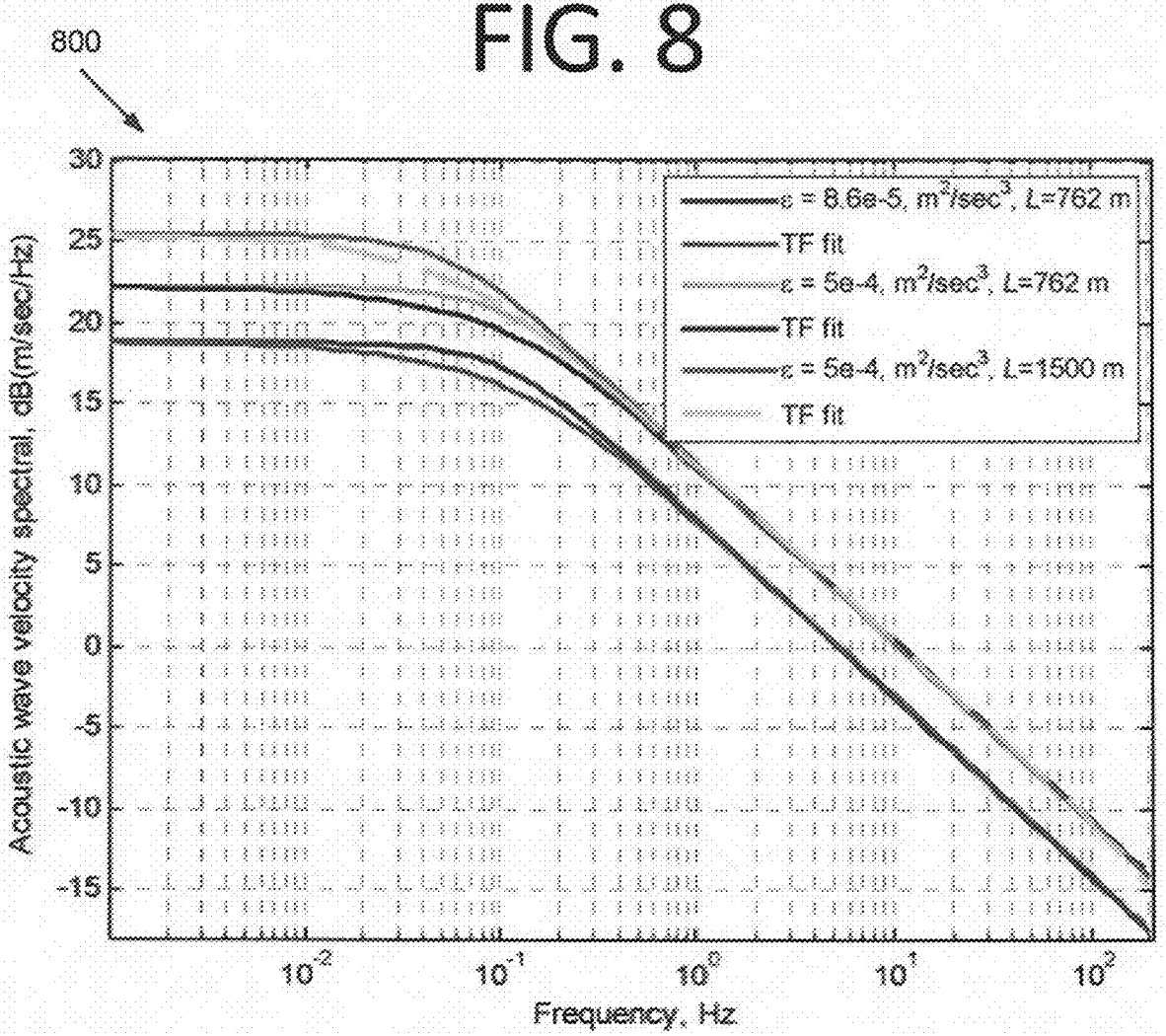
FIG. 8 illustrates a graph of a von Karman acoustic wave velocity spectral and its TF fits due to different values of eddy dissipation rates and integral length scales, according to an embodiment of the present invention.

Graph 800 of FIG. 8 shows spectral density TF fits, first, with a fixed integral length scale and two different values of E. This shows that the differences in $\epsilon$ produce a fixed offset in magnitude, but with the same pole-zero frequencies. FIG. 8 also shows a comparison between two spectral densities with the same value of $\epsilon$ and two different values of L. This comparison, with different values of L, is represented with different pole-zero frequencies. However, the high frequency asymptotes match, which means that for the purpose of controls design, either of these TF fits can be utilized despite their differences in pole-zero frequencies.

Therefore, the frequency domain atmospheric turbulence model can be simplified by utilizing the model developed in the previous section to calculate the fixed frequencies due to a fixed integral length scale and variable eddy dissipation rates. Based on that, the simplified model developed for atmospheric turbulence, which ignores differences in the pole-zero frequencies due to different integral length scales can be represented as $$G_{LA}(s) = 70\varepsilon^{2/9}\frac{\left(\frac{s}{9.2}+1\right)\left(\frac{s}{55.0}+1\right)\left(\frac{s}{335.5}+1\right)}{\left(\frac{s}{1.46}+1\right)\left(\frac{s}{30.1}+1\right)\left(\frac{s}{85.7}+1\right)\left(\frac{s}{1593.1}+1\right)} \tag{30}$$

$$G_{VA}(s) = 56\varepsilon^{2/9}\frac{\left(\frac{s}{9.2}+1\right)\left(\frac{s}{55.0}+1\right)\left(\frac{s}{335.5}+1\right)}{\left(\frac{s}{1.46}+1\right)\left(\frac{s}{30.1}+1\right)\left(\frac{s}{85.7}+1\right)\left(\frac{s}{1593.1}+1\right)} \tag{31}$$

$$G_T(s) = 943\varepsilon^{2/6}\frac{\left(\frac{s}{33.0}+1\right)\left(\frac{s}{45.6}+1\right)\left(\frac{s}{602.4}+1\right)}{\left(\frac{s}{1.1}+1\right)\left(\frac{s}{25.1}+1\right)\left(\frac{s}{109.8}+1\right)\left(\frac{s}{816.3}+1\right)} \tag{32}$$

$$G_{TLA}(s) = 472\varepsilon^{2/6}\frac{(M_\infty - 1)}{\sqrt{M_\infty^2 - 1}}\frac{M\gamma R}{a_o}\frac{\left(\frac{s}{33.0}+1\right)\left(\frac{s}{45.6}+1\right)\left(\frac{s}{602.4}+1\right)}{\left(\frac{s}{1.1}+1\right)\left(\frac{s}{25.1}+1\right)\left(\frac{s}{109.8}+1\right)\left(\frac{s}{816.3}+1\right)} \tag{33}$$

$$G_{TVA}(s) = 472\varepsilon^{2/6}\frac{M\gamma R}{a_o}\frac{\left(\frac{s}{33.0}+1\right)\left(\frac{s}{45.6}+1\right)\left(\frac{s}{602.4}+1\right)}{\left(\frac{s}{1.1}+1\right)\left(\frac{s}{25.1}+1\right)\left(\frac{s}{109.8}+1\right)\left(\frac{s}{816.3}+1\right)} \tag{34}$$

$$G_p(s) = 859\varepsilon^{2/6}\frac{\left(\frac{s}{33.0}+1\right)\left(\frac{s}{45.6}+1\right)\left(\frac{s}{602.4}+1\right)}{\left(\frac{s}{1.1}+1\right)\left(\frac{s}{25.1}+1\right)\left(\frac{s}{109.8}+1\right)\left(\frac{s}{816.3}+1\right)} \quad (33)$$

Where $G_{LA}$, $G_{VA}$, $G_T$, $G_{TLA}$, $G_{TVA}$, and $G_P$ are the simplified atmospheric disturbance TFs for longitudinal and transverse acoustic wave velocity, temperature, longitudinal acoustic velocity due to temperature, and vertical acoustic velocity due to temperature, and pressure, respectively. The factor $$(M_\infty - 1)\Big/\sqrt{M_\infty^2 - 1}$$

in equation (33) can be set for worst case turbulence conditions, especially for relatively high Mach numbers, in which case it makes equation (33) and equation (34) the same. It is noted that $M_\infty$ pertains to the freestream Mach number, which is the same as the vehicle Mach number.

The TF fit described in the previous section was carried up to 200 Hz, which should make it accurate even beyond this frequency range. However, the model simplification represented by equations (30) to (35) introduces additional errors at high frequencies and its validity should be limited to about 200 Hz. The frequencies of this model are based on an integral length scale of L=762 m. This means that this simplified model may not be unique, and other equivalent models can be calculated using different values of L with the equations developed in the previous sections. Thus, for a controls design which can adequately attenuate 1 Hz disturbances, this model is accurate for values of L as low as 100 m, which is well below the expected range of L. A value of L=762 m is considered standard in the aerospace industry, as mentioned previously.

Time Domain Disturbances

The TF fits in the previous section can be thought of as filters, which take input disturbances at desirable frequencies and convert them to representative free stream atmospheric disturbances. The TF fits contain the representative magnitudes of these disturbances. Thus, the discrete time domain frequencies $W_t$ may only need to have unity root mean square (RMS) values. For instance, a time domain input can be constructed as a sum of unit amplitude sinusoids, starting at the low frequency asymptote of the spectral, and continuing up with sinusoids that are dispersed along the high frequency asymptote up to frequencies that cover the controller bandwidth. Also, the control design can be checked with single frequency sinusoids, sequentially simulated. The total energy or the maximum amplitude of the disturbance will need to be reasonable. For instance, it may be considered that total wind gust will not exceed an amplitude of 180 mph, or some other reasonable number that depends on altitude.

For most of the spectral density simulations covered so far, the worst case eddy dissipation rate for low to moderate turbulence was used for altitudes of about 36,000 ft (~11 km) and above. However, the highest atmospheric turbulence ever recorded had an eddy dissipation rate of 1.7e-3 ($m^2/sec^3$). Theoretically, it is possible that even more severe turbulence can be encountered.

Conventional approaches cover atmospheric turbulence probabilistically, as an exceedance for controls design purposes. In terms of probabilistic atmospheric turbulence models, there are no comparisons drawn here between those models and the non-probabilistic approach described herein, even though exceedance can also be incorporated with this approach. The modeling approach developed herein is geared towards implementing a controls design by considering worst case atmospheric turbulence. This also allows implementation of control designs to cover worst case turbulence encounters without penalizing performance under normal atmospheric conditions by incorporating control scheduling in the design.

Figure 9:
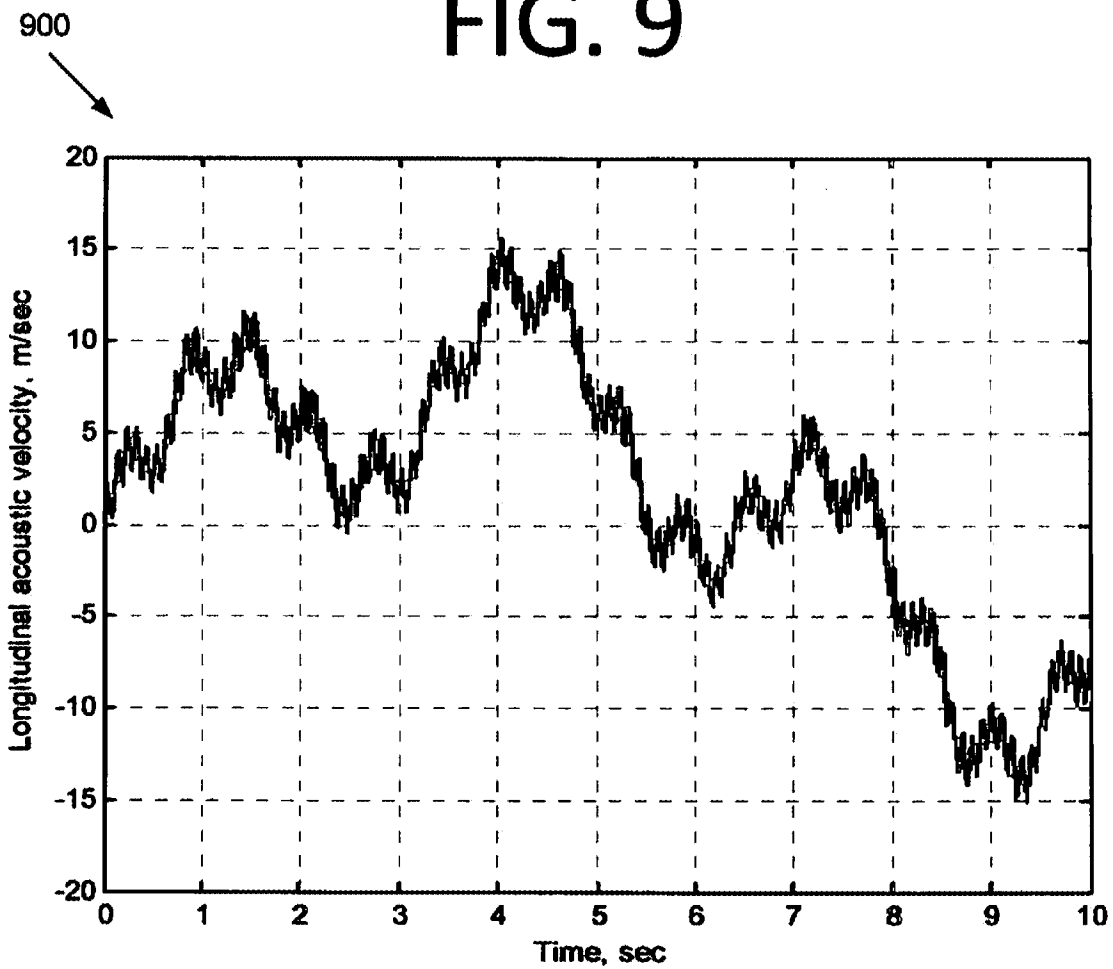
FIG. 9 illustrates a graph of longitudinal acoustic wave velocity disturbance created using the TF fit of the longitudinal acoustic wave with unity input sinusoids, according to an embodiment of the present invention.

Graph 900 of FIG. 9 shows a time domain longitudinal acoustic wave disturbance utilizing the acoustic wave TF fit discussed in the previous section. The input to this TF is a combination of unity amplitude sinusoids distributed along the frequency range shown in FIG. 1. For a single unity amplitude sinusoid at low frequency, the amplitude of the acoustic disturbance would be approximately 9 m/sec according to FIG. 1. For this summation of unity amplitude input sinusoids, their amplitudes combine to give approximately 15 msec maximum disturbance. The same approach can be used to construct other atmospheric disturbances for time domain simulations.

Figure 10:
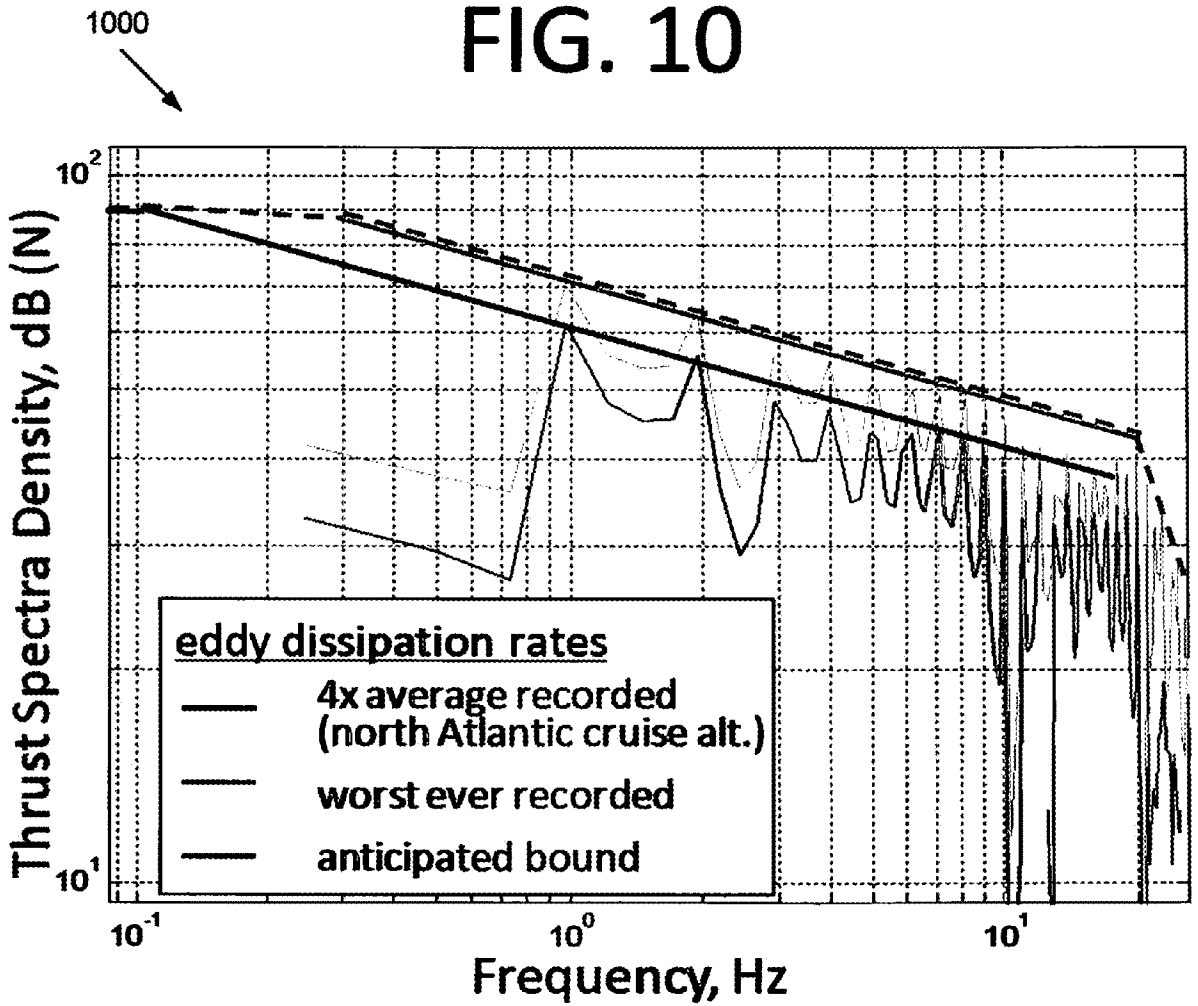
FIG. 10 is a graph illustrating a thrust spectral density analysis, according to an embodiment of the present invention.

FIG. 10 is a graph 1000 illustrating a thrust spectral density analysis, according to an embodiment of the present invention. The thrust spectral density analysis is for a certain propulsion system subjected to atmospheric disturbances for two different eddy dissipation rates (severity of disturbances) with unity frequency sinusoids selected as inputs to the atmospheric disturbance TFs to limit the combined wind gust velocities to certain values. Graph 1000 also shows the spectra density limits with frequency, with the dashed line indicating the worst anticipated bounds of this spectral. Even though not shown in FIG. 10, a different choice of input sinusoids of lower frequencies that also meets the selected wind gust limits will produce spectral densities with amplitudes with peaks that are bounded by these straight line bounds at these lower frequencies. Such an analysis, for instance, can be used to assess the vehicle ride quality or to assess the propulsive forces coupled to the body modes of the vehicle.

FIG. 11 is a flowchart 1100 illustrating a method of approximating fractional order atmospheric turbulence with integer order pole-zero transfer function fits, according to an embodiment of the present invention. In some embodiments, the method of FIG. 11 may be implemented, for example, by computing system 1200 of FIG. 12. The method begins with selecting the flight conditions and disturbance parameters at 1105. Next, the pole-zero density and number of frequency decades are selected at 1110. The corresponding natural frequency is computed at 1115 and the pole-zero frequencies are computed at 1120.

If simplified TFs are to be used at 1125, simplified TFs for controls design are computed at 1130. Otherwise, adjusting factors are applied and TFs are computed for each disturbance type at 1135. The TFs are then configured for the overall disturbance simulation at 1140, and unity amplitude sinusoids are constructed and distributed up to a frequency corresponding to the vehicle speed at 1145. The simulation is then run at 1150.

If the selected maximum wind velocity is not satisfied at 1155, the process returns to adjusting the unity amplitude sinusoids (i.e., appropriately changing the frequencies of the sinusoids and/or the number of sinusoids) at 1145. Otherwise, the process checks whether the user desires to generate another model at 1160. If so, the process returns to the beginning at 1105. Otherwise, the model is run and the results are plotted at 1165. Optionally, cases may be run and spectral density analysis may be constructed at 1170. Otherwise, the process ends or the simulation is connected to the vehicle system model to run simulations. In some embodiments, the algorithm process is setup to run automatically in a computer program, and some of the steps like setting up the process, choosing the unit amplitude sinusoids, generating a different model, and running vehicle system analysis may require user involvement.

Figure 12:
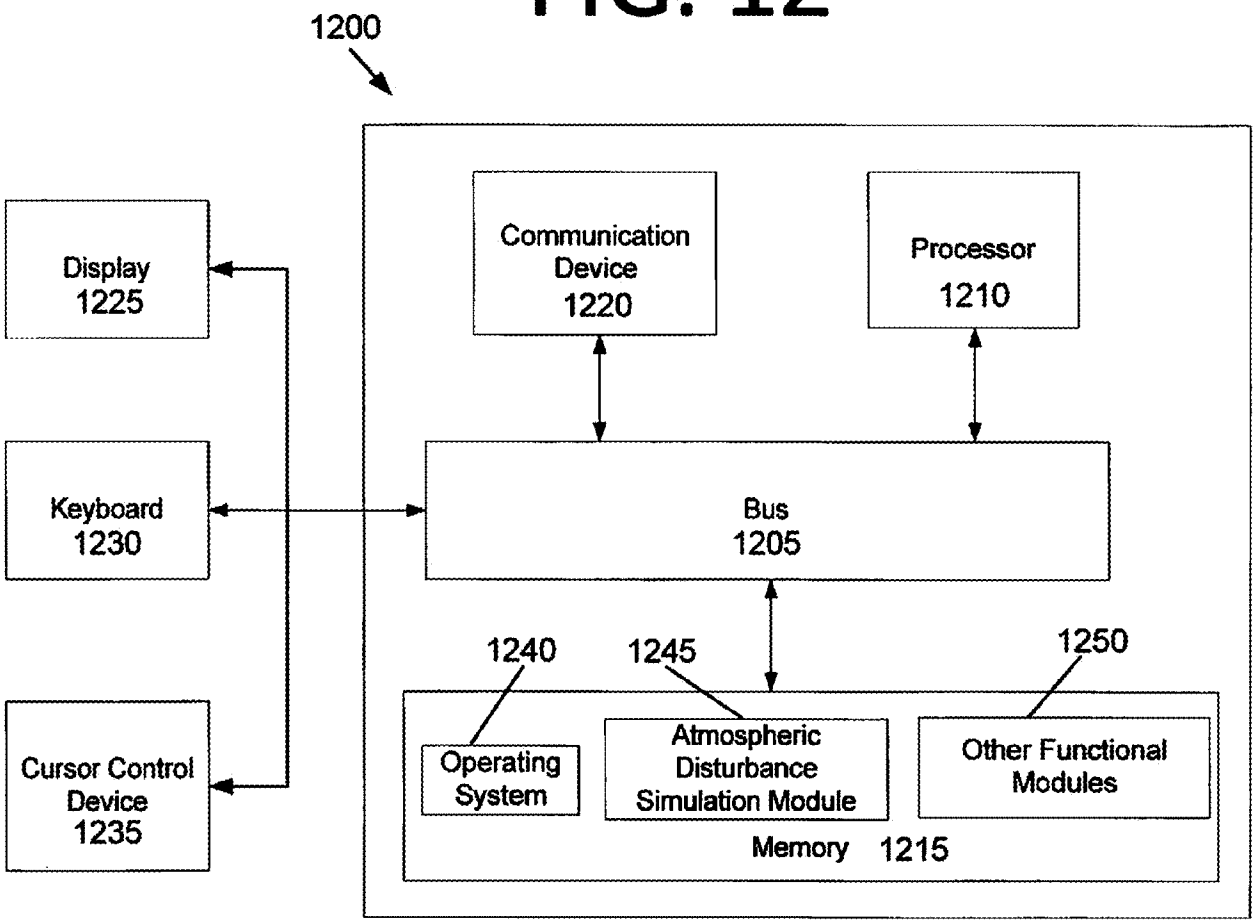
FIG. 12 illustrates a computing system, according to an embodiment of the present invention.

FIG. 12 illustrates a computing system, according to an embodiment of the present invention. System 1200 includes a bus 1205 or other communication mechanism for communicating information, and a processor 1210 coupled to bus 1205 for processing information. Processor 1210 may be any type of general or specific purpose processor, including a central processing unit (CPU) or application specific integrated circuit (ASIC). System 1200 further includes a memory 1215 for storing information and instructions to be executed by processor 1210. Memory 1215 can be comprised of any combination of random access memory (RAM), read only memory (ROM), flash memory, cache, static storage such as a magnetic or optical disk, or any other types of non-transitory computer-readable media or combinations thereof. Additionally, system 1200 includes a communication device 1220, such as a wireless network interface card, to provide access to a network.

Non-transitory computer-readable media may be any available media that can be accessed by processor 1210 and may include both volatile and non-volatile media, removable and non-removable media, and communication media. Communication media may include computer-readable instructions, data structures, program modules or other data in a modulated data signal such as a carrier wave or other transport mechanism and includes any information delivery media.

Processor 1210 is further coupled via bus 1205 to a display 1225, such as a Liquid Crystal Display ("LCD"), for displaying information to a user. A keyboard 1230 and a cursor control device 1235, such as a computer mouse, are further coupled to bus 1205 to enable a user to interface with system 1200. However, in certain embodiments such as those for mobile computing implementations, a physical keyboard and mouse may not be present, and the user may interact with the device solely through display 1225 and/or a touchpad (not shown). Any type and combination of input devices may be used as a matter of design choice.

In one embodiment, memory 1215 stores software modules that provide functionality when executed by processor 1210. The modules include an operating system 1240 for system 1200. The modules further include an atmospheric disturbance simulation module 1245 that is configured to simulate atmospheric disturbances using a TF fit. System 1200 may include one or more additional functional modules 1250 that include additional functionality.

One skilled in the art will appreciate that a "system" could be embodied as a personal computer, a server, a console, a personal digital assistant ("PDA"), a cell phone, a tablet computing device, or any other suitable computing device, or combination of devices. Presenting the above-described functions as being performed by a "system" is not intended to limit the scope of the present invention in any way, but is intended to provide one example of many embodiments of the present invention. Indeed, methods, systems and apparatuses disclosed herein may be implemented in localized and distributed forms consistent with computing technology, including cloud computing systems.

It should be noted that some of the system features described in this specification have been presented as modules, in order to more particularly emphasize their implementation independence. For example, a module may be implemented as a hardware circuit comprising custom very large scale integration ("VLSI") circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module. Further, modules may be stored on a computer-readable medium, which may be, for instance, a hard disk drive, flash device, random access memory ("RAM"), tape, or any other such medium used to store data.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The method steps performed in FIG. 11 may be performed by a computer program, encoding instructions for the nonlinear adaptive processor to perform at least the method described in FIG. 11, in accordance with an embodiment of the present invention. The computer program may be embodied on a non-transitory computer-readable medium. The computer-readable medium may be, but is not limited to, a hard disk drive, a flash device, a random access memory, a tape, or any other such medium used to store data. The computer program may include encoded instructions for controlling the nonlinear adaptive processor to implement the method described in FIG. 11, which may also be stored on the computer-readable medium.

The computer program can be implemented in hardware, software, or a hybrid implementation. The computer program can be composed of modules that are in operative communication with one another, and which are designed to pass information or instructions to display. The computer program can be configured to operate on a general purpose computer, or an application specific integrated circuit ("ASIC").

Some embodiments of the present invention use derivations to approximate fractional order atmospheric turbulence with integer order pole-zero transfer function fits for more accurate time domain simulations. An existing von Karman type model form of the Kolmogorov spectral is utilized initially for acoustic velocity gust disturbances. This model may be scaled in order to develop the von Karman forms for other types of atmospheric disturbance, such as temperature, pressure, and density. A circuit equivalent may be used as the basis to derive the integer order pole-zero approximations. The TF poles and zeros of the approximations to the atmospheric disturbances can be directly computed for different parameters describing atmospheric disturbance.

It will be readily understood that the components of various embodiments of the present invention, as generally described and illustrated in the figures herein, may be arranged and designed in a wide variety of different configurations. Thus, the detailed description of the embodiments of the systems, apparatuses, methods, and computer programs of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

NOMENCLATURE

The following Nomenclature is used in claim 6 and is defined as:

q fractional order of equivalent electrical circuit

η the ratio of each decade interval where a pole or a zero will be used to estimate the fractional order TF $m_z$ number of zeros in the TF approximation $m_p$ number of poles in the TF approximation $\omega_{pi}$ frequency of TF pole i of integer order approx. (rad/sec)

$\omega_{zi}$ frequency of TF zero i of integer order approx. (rad/sec)

$K_{\omega pi}$ proportional gain for the calculation of the ith pole frequency $\omega_{Hpi}$ symmetry frequency of the ith zero (rad/sec) to guarantee symmetric placement of approximation $K_{\omega zi}$ proportional gain for the calculation of the ith zero frequency $\omega_{Hzi}$ symmetry frequency of the ith zero (rad/sec) to guarantee symmetric placement of approximation.

The invention claimed is:

1. A non-transitory computer readable storage storing computer executable instructions which when executed by a computer perform a process comprising:

scaling a Kolmogorov spectral to convert the Kolmogorov spectral into a finite energy von Karman spectral;

deriving a fractional order pole-zero transfer function (TF) from the von Karman spectral;

approximating fractional order atmospheric turbulence with an integer order pole-zero TF fit; and storing the approximation in memory.

2. The process of claim 1, further comprising:

displaying, via a display device, a graph of the integer order pole-zero TF fit of the von Karman spectral.

3. The process of claim 1, further comprising:

receiving and incorporating a user-selected flight condition and atmospheric turbulence parameters.

4. The process of claim 1, wherein the integer order pole-zero TF fit is symmetrically centered about the fractional order pole-zero TF by interleaving integer order poles and zeros.

5. The process of claim 1, wherein a frequency of integer order poles and zeros is related to atmospheric disturbance parameters derived such that the integer order pole-zero TF fit is symmetrically centered about the fractional order pole-zero TF.

6. The process of claim 1, wherein the process further causes the processor to determine a frequency of poles by an equation $$\omega_{pi} = \frac{K_{\omega pi}\omega_{Hpi}\prod_{j=1}^{i-1}(\omega_{Hpi}/\omega_{pi-j}+1)}{10^{\eta(2i-1)*q}\prod_{j=1}^{i-1}(\omega_{Hpi}/\omega_{zi-j}+1)-1} \quad i=2,3\ \ldots\ ,m_p$$

and determine a frequency of zeros by an equation $$\omega_{zi} = \frac{K_{\omega zi}\omega_{Hzi}\prod_{j=1}^{i-1}(\omega_{Hzi}/\omega_{zi-j}+1)}{10^{-2\eta i*q}\prod_{j=1}^{i}(\omega_{Hzi}/\omega_{pi}+1)-1} \quad i=2,3\ \ldots\ ,m_z.$$

wherein q=fractional order of equivalent electrical circuit,

η=the ratio of each decade interval where a pole or a zero will be used to estimate the fractional order TF, $m_z$=number of zeros in the TF approximation, $m_p$=number of poles in the TF approximation, $\omega_{pi}$=frequency of TF pole i of integer order approx. (rad/sec), $\omega_{zi}$=frequency of TF zero i of integer order approx. (rad/sec), $K_{\omega pi}$=proportional gain for the calculation of the ith pole frequency, $\omega_{Hpi}$=symmetry frequency of the ith zero (rad/sec) to guarantee symmetric placement of approximation, $K_{\omega zi}$=proportional gain for the calculation of the ith zero frequency, $\omega_{Hzi}$=symmetry frequency of the ith zero (rad/sec) to guarantee symmetric placement of approximation.

7. The process of claim 1, wherein the process further causes the processor to determine a longitudinal fit by equation $$K_{l,fit}=(5.4\epsilon^{2/3}L^{5/3})^{1/3}$$

determine a transverse disturbance by $$K_{v,fit}=(2.7\epsilon^{2/3}L^{5/3})^{1/3},$$

and scale associated TF frequencies for a better fit, wherein $\epsilon$=eddy dissipation rate ($m^2/sec^3$), L=integral length scale.

8. The process of claim 1, wherein the process further causes the processor to determine an integer order pole-zero TF fit for temperature by equation $$K_{T,fit(temp)}=\sqrt[4]{14.0\epsilon^{2/3}L^{5/3}},$$

wherein $\epsilon$=eddy dissipation rate ($m^2/sec^3$),

L=integral length scale, scale associated integer order pole-zero TF parameters for a better fit, and determine the integer order pole-zero TF parameters associated with wind gusts due to temperature and pressure disturbances.

9. A computer-implemented method, comprising:

simulating, by a processor, atmospheric disturbances in both a time and frequency domain using an integer order pole-zero transfer function (TF) fit of a fractional order pole-zero TF; and displaying, on a display device, a graphical representation of the integer order pole-zero TF fit.

10. The computer-implemented method of claim 9, further comprising:

deriving, by the processor, the fractional order pole-zero TF from a von Karman spectral.

11. The computer-implemented method of claim 10, wherein the von Karman spectral is a finite energy conversion of a Kolmogorov spectral.

12. The computer-implemented method of claim 10, further comprising:

selecting, by the processor, an offset decibel level such that a resultant horizontal asymptote of the integer order pole-zero TF fit approximates a corresponding horizontal asymptote of the von Karman spectral.

13. The computer-implemented method of claim 9, wherein the integer order pole-zero TF fit is symmetrically centered about the fractional order pole-zero TF by interleaving integer order poles and zeros.

14. The computer-implemented method of claim 9, wherein a frequency of integer order poles and zeros is related to atmospheric disturbance parameters derived such that the integer order pole-zero TF fit is symmetrically centered about the fractional order pole-zero TF.

15. An apparatus, comprising:

physical memory comprising computer program instructions; and a processor configured to execute the computer program instructions, the processor configured to:

determine simulated atmospheric disturbances using an integer order pole-zero transfer function (TF) fit of a fractional order pole-zero TF, and store the integer order pole-zero TF fit in the memory.

16. The apparatus of claim 15, the processor further configured to:

derive the fractional order pole-zero TF from a von Karman spectral.

17. The apparatus of claim 16, wherein the von Karman spectral is a finite energy conversion of a Kolmogorov spectral.

18. The apparatus of claim 16, the processor further configured to:

select an offset decibel level such that a resultant horizontal asymptote of the integer order pole-zero TF fit approximates a corresponding horizontal asymptote of the von Karman spectral.

19. The apparatus of claim 15, wherein the integer order pole-zero TF fit is symmetrically centered about the fractional order pole-zero TF by interleaving integer order poles and zeros.

20. The apparatus of claim 15, wherein a frequency of integer order poles and zeros is related to atmospheric disturbance parameters derived such that the integer order pole-zero TF fit is symmetrically centered about the fractional order pole-zero TF.

* * * * *